United States Patent [19]

Laurent

[11] 4,080,808

[45] Mar. 28, 1978

[54] PNEUMATIC FEED

[75] Inventor: Maurice Laurent, Tassin-la-Demi-Lune, France

[73] Assignee: Rhone Poulenc Textile, Paris, France

[21] Appl. No.: 710,657

[22] Filed: Aug. 2, 1976

[30] Foreign Application Priority Data

Aug. 4, 1975 France ..... 75 24463

[51] Int. Cl.[2] ..... D04B 15/48

[52] U.S. Cl. ..... 66/125 R

[58] Field of Search ..... 66/125 R, 132 R, 13, 66/9 R

[56] References Cited

U.S. PATENT DOCUMENTS

| | | | |
|---|---|---|---|
| 3,115,024 | 12/1963 | Walrabenstein | 66/9 R X |
| 3,134,248 | 5/1964 | Kubelka | 66/125 R |
| 3,813,900 | 6/1974 | Cook et al. | 66/125 R |
| 3,890,809 | 6/1975 | Tenconi | 66/132 R |
| 3,926,224 | 12/1975 | Vermeulen et al. | 66/132 R X |
| 3,955,379 | 5/1976 | Corbiene | 66/132 R |
| 3,961,498 | 6/1976 | Braunschweiler | 66/13 |

FOREIGN PATENT DOCUMENTS

| | | | |
|---|---|---|---|
| 2,098,814 | 3/1972 | France | 66/125 R |
| 1,904,219 | 8/1970 | Germany | 66/125 |

*Primary Examiner*—Mervin Stein
*Assistant Examiner*—A. M. Falik
*Attorney, Agent, or Firm*—Sherman & Shalloway

[57] ABSTRACT

A high speed knitting machine and method, in which yarn is fed to the needles of the knitting machine by fluid under pressure in a feed conduit, in such a way that it is directed into the hooks of the needles tangentially to the stems of the needles.

3 Claims, 3 Drawing Figures

PNEUMATIC FEED

The present invention relates to a knitting machine and to a method of knitting enabling at least one yarn to be knitted at high speed.

More particularly the invention is concerned with a method and an apparatus of improving knitting according to the so-called "gathered stitches" techniques, that is to say the technique according to which the yarn feeds all the operative needles in each row of stitches.

In the description which follows the invention will be described as applied to a needle bar (or needle cylinder), single feeder circular knitting machine having needle stems with hooks at their upper ends and latches, the needles being reciprocated axially of the stems by rotating annular cams. It is clear that, subject to certain adaptations which are within the scope of the man skilled in the art, the invention may also be applied to other types of knitting machines with gathered stitches, such as flat knitting machines, multifeeder circular frames and circular knitting machines with bearded needles. The term "hook" is thus intended to cover hooks with latches or beards.

In simple bar, single feeder circular knitting machines with needles with hooks and latches and, which are driven by rotating, the feeding of the yarn over the needles is obtained by means of a yarn guide the movement of which is synchronised with the movement of the cams controlling the movement of the needles. In certain cases the yarn is supplied to the yarn guide by means of a distributor which enables a constant length of yarn to be supplied under a predetermined tension.

It is well known that during the formation of the stitches or loops the yarn is subjected to major stresses because of the tensions which are exerted especially during the gathering (taking the yarn into the hook or beard of the needles) and during the stage of knocking over or casting off of the formed stitch. Moreover, since the yarn is in contact with the surface of the yarn guides uncontrollable stresses are produced also at that level. All these stresses are the greater the faster is the speed of knitting and dependent on the nature of the yarns employed it is necessary to restrict the speed if it is desired to obtain an article of satisfactory quality.

Although the present-day knitting speeds provide a satisfactory compromise between the productivity and the quality of the articles produced, they are considered inadequate when knitting is utilised as an intermediate stage in the manufacture of chemical yarns. Thus there has recently been developed a technique of texturising synthetic yarns which consists in knitting a yarn, thermally treating the thus formed knitted fabric, and then recovering the yarn by unknitting or unravelling. This technique makes it possible to obtain crimped yarns which have characteristics which are appreciated in certain applications but which are expensive, more particularly as a result of the low production capacities of the machines employed which, in general do not enable more than 300 to 400 meters of yarn to be taken up per minute.

Furthermore, a recent technique proposes to replace the winding operation in the form of bobbins by storage in the form of a knitted fabric obtained directly downstream of extrusion or spinning elements. While, theoretically, this technique would appear to be attractive, from a practical point of view numerous problems arise because the knitting has to be effected at very high speed and weaknesses or flaws must not be caused in yarns which are stored in this manner. Until now however, and mainly in the case of knitting unstretched or partially stretched yarns, it has been found that it is virtually impossible to obtain uniform articles because of the uncontrollable mechanical stresses exerted on the yarn during formation of the stitches.

According to the present invention there is provided a method of knitting at least one yarn into a knitted fabric in which said at least one yarn is fed to the knitting machine by a current of fluid under pressure which is directed to feed the yarn tangentially across the stems of the needles in the gathering zone.

Such a method limits and regularises the stresses exerted on the yarn during knitting and enables perfectly uniform articles to be obtained at very fast speeds.

The invention also provides a knitting machine for knitting at least one yarn into a knitted fabric, said machine comprising a plurality of needles having stems and hooks, means for reciprocating said needles axially of the stems, a continuous yarn feed conduit having an upstream end and a downstream end, and a nozzle for directing fluid into the upstream end of the conduit, the downstream end of the nozzle being disposed to direct the fluid and yarn tangentially to the stems of the needles.

In a preferred construction the needles are latch needles arranged in a circle to form a simple bar circular knitting machine, and the means to reciprocate the needles comprises an annular rotating cam, said continuous yarn feed conduit being mounted for rotation synchronously with said cam, the position of the downstream end of the conduit being such that the yarn is fed into the hooks of the needles during their downward movement at the instant when the closing of the latches begin.

The invention will be better understood from the following description, which is given merely by way of example, reference being made to the accompanying drawings, in which.

Figure 1:
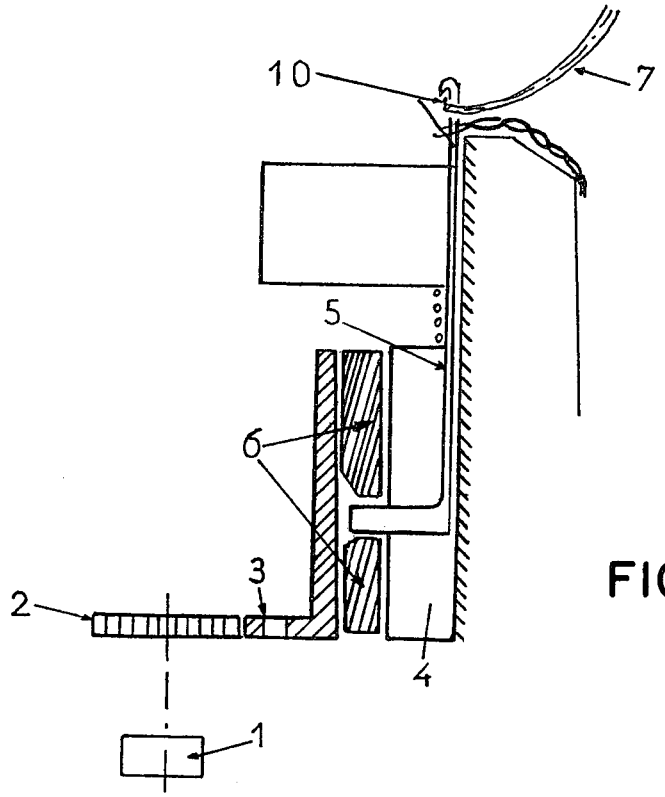
FIG. 1 is a fragmentary section which shows the principal elements of a circular knitting machine.

As can be seen in these drawings the knitting machine comprises the conventional elements of a simple bar circular knitting machine with latch needles, i.e. a motor 1 controlling gear 2 which rotatably drives the ring gear 3 of an annular cam 6, and a stationary, grooved cylinder 4 enabling vertical displacement of the needles 5 controlled by the annular cam 6 formed in the ring gear 3.

Figure 3:
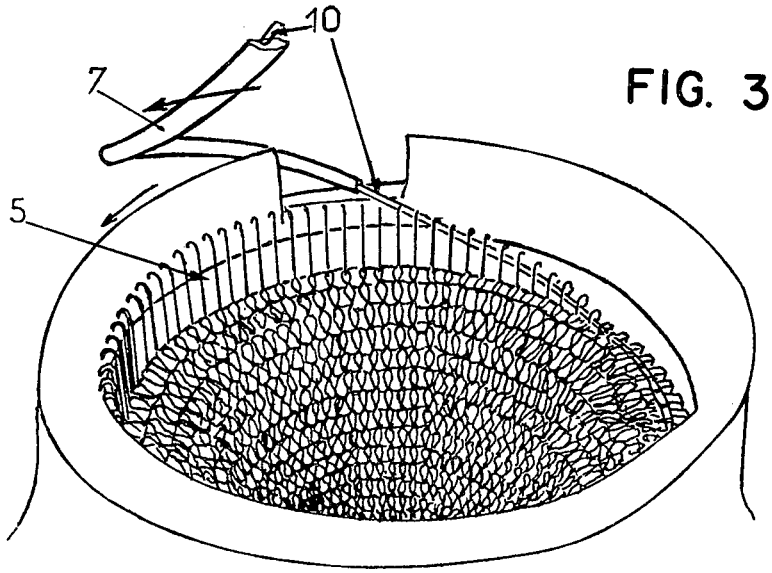
FIG. 3 shows in perspective the feeding of the yarn into the needles of the machine of FIG. 2.
Figure 2:
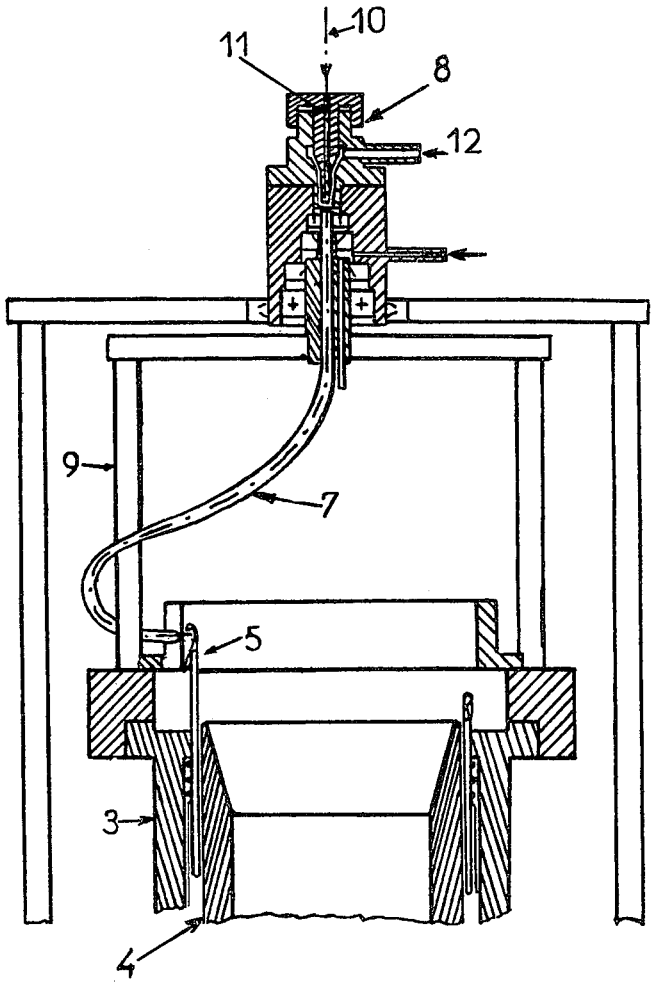
FIG. 2 is a perspective view of one embodiment of circular knitting machine according to the invention.

In accordance with the invention, and as best seen in FIGS. 2 and 3, the feeding of the yarn into the needles is effected by means of a continuous conduit 7 through which compressed air derived from a pneumatic nozzle 8 passes. This conduit is rotatable and its movement is synchronised with that of the annular cam which controls the movement of the needles. In the present construction, the conduit is fixed to the ring gear 3 by means of posts 9.

The configuration of the continuous conduit 7 which feeds the yarn preferably conforms to that shown in the Figures, since such a configuration makes it possible to bring the yarn with precision to the needles in the zone where the latches begin to close. Consequently, in normal operation, the yarn 10 supplied from a bobbin (or perhaps directly from a spinning station) is fed to the chamber 11 of the nozzle at the upstream end of the conduit and then, under the influence of the fluid 12 in the continuous conduit 7 which, in its rotary movement, directs the yarn at the downstream end of the conduit into every one of the needles in the manner shown in FIG. 3.

Using this arrangement it is possible to knit 1100 dtex/135 filaments polyhexamethylene adipamide yarn at over 800 meters per minute on a 6 gauge frame, number of needles 80, diameter about 14 cm (5 inches) revolving at a rate of 600 r.p.m., the nozzle being fed by compressed air at a pressure of 3 bars.

A further advantage of this construction resides in the fact that a light twist is also imparted to the yarn during its feeding, which is particularly advantageous when the knitting is performed with untwisted yarns, for example directly after extrusion or spinning.

I claim:

1. In a method of knitting at high speeds at least one yarn into a knitted fabric in which at least one yarn is fed to the needles in the gathering zone of a knitting machine by a current of fluid under pressure the improvement comprising directing the current of fluid tangentially across the needle stems to feed the yarn tangentially with respect to the stems of the needles in the gathering zone.

2. A high speed knitting machine for knitting at least one yarn into a knitted fabric, said machine comprising a plurality of needles having stems and hooks, means for reciprocating said needles axially of the stems, a continuous yarn feed conduit having an upstream end and a downstream end, and a nozzle for directing fluid into the upstream end of the conduit, the downstream end of the nozzle being disposed to direct the fluid and yarn tangentially across the stems of the needles.

3. A knitting machine as claimed in claim 2, wherein said needles are latch needles arranged in a circle to form a needles bar circular knitting machine, and the means to reciprocate the needles comprises an annular rotating cam, said continuous yarn feed conduit being mounted for rotation synchronously with said cam, the position of the downstream end of the conduit being such that the yarn is fed into the hooks of the needles during their downward movement at the instant when the closing of the latches begin.

* * * * *